US007857643B2

(12) United States Patent
Dobler

(10) Patent No.: US 7,857,643 B2
(45) Date of Patent: Dec. 28, 2010

(54) XLR CABLE CONNECTOR

(75) Inventor: Oliver Dobler, Tschagguns (AT)

(73) Assignee: Neutrik Aktiengesellschaft, Schaan (LI)

( * ) Notice: Subject to any disclaimer, the term of this patent is extended or adjusted under 35 U.S.C. 154(b) by 0 days.

(21) Appl. No.: 12/414,997

(22) Filed: Mar. 31, 2009

(65) Prior Publication Data

US 2009/0186503 A1 Jul. 23, 2009

Related U.S. Application Data

(63) Continuation of application No. PCT/AT2007/000425, filed on Sep. 7, 2007.

(30) Foreign Application Priority Data

Oct. 9, 2006 (DE) ..... 10 2006 048 014
Sep. 7, 2007 (WO) ..... PCT/AT2007/000425

(51) Int. Cl.
*H01R 29/00* (2006.01)

(52) U.S. Cl. ..... 439/172; 439/176

(58) Field of Classification Search ..... 439/170–172, 439/176

See application file for complete search history.

(56) References Cited

U.S. PATENT DOCUMENTS 2,538,296 A * 1/1951 Crocker ..... 439/172
3,025,486 A 3/1962 Falconer
3,083,344 A * 3/1963 Long ..... 439/172
3,644,938 A 2/1972 Slate
5,791,921 A * 8/1998 Lee ..... 439/172
6,722,902 B2 * 4/2004 Kedzierski ..... 439/173
6,923,666 B1 * 8/2005 Liao ..... 439/172
7,001,192 B1 * 2/2006 Yeh ..... 439/131
7,465,901 B2 * 12/2008 Yunk et al. ..... 219/130.1
2006/0141865 A1 6/2006 Su et al.

FOREIGN PATENT DOCUMENTS

EP 1592091 A1 11/2005
FR 2466883 4/1981

OTHER PUBLICATIONS

International Search Report dated Feb. 15, 2008 for PCT/AT2007/000425.

* cited by examiner

*Primary Examiner*—Hien Vu
(74) *Attorney, Agent, or Firm*—Harris Beach PLLC; Neal L. Slifkin

(57) ABSTRACT

The XLR cable connector comprises a sliding element, by means of whose displacement between a retracted and an advanced end position, the XLR cable connector can be converted between a plug and a socket, and that has a first, a second, a third, and a fourth channel, a first, a second, and a third contact pin that are received by the first, second, and third channel of the sliding element, whereby in the retracted position of the sliding element, these contact pins project from the plug-in-side front face of the sliding element, and in the advanced end position of the sliding element, these contact pins are retracted into the channels of the sliding element.

22 Claims, 4 Drawing Sheets

14
13
22
9
11
10
25
26
43
1
42
29
8
2
30
3
7
6
5
4
17
15
23
16
32
33
35
36
27
34
31
37
28

XLR CABLE CONNECTOR

CROSS-REFERENCE OF RELATED APPLICATIONS

This invention is a Continuation-In-Part of PCT/AT2007/000425.

BACKGROUND OF THE INVENTION a) Scope of the Invention

The invention relates to an XLR cable connector.

b) Description of Related Prior Art

XLR cable connectors to create electrical plug-and-socket connections, especially to transmit audio signals, are known and are offered by various manufacturers. Among connectors, one generally differentiates between plugs (male) that have contact pins as electrical contact elements, and sockets (female) that have contact tubes, into which the contact pins of a plug can be inserted. In addition, one also differentiates connectors as being cable connectors, also known as open connectors for attaching to an electric cable, and appliance connectors that can be built into an electrical device and are also known as chassis or receptacle connectors. Both cable as well as appliance connectors can be constructed as plugs or sockets. In regard to XLR connectors, all these constructions are known. XLR cable connectors constructed as plugs can be connected to XLR appliance connectors constructed as sockets or to XLR cable connectors constructed as sockets. XLR cable connectors constructed as sockets can be connected to XLR cable connectors constructed as plugs and to XLR appliance connectors constructed as plugs.

XLR connectors are standardized in standard IEC 61076-2-103. Besides 3-pin XLR connectors, XLR connectors with other pin-numbers, especially 4-7-pins, are also known.

In actual practice, the problem may arise that two XLR connectors constructed as plugs or two XLR connectors constructed as sockets are to be connected to each other. To do so, adapters known as "gender changers" are available that can be attached to the corresponding connector. The disadvantage in this case is that there are separate parts that each must be procured and that can be lost.

SUMMARY OF THE INVENTION

The object of the invention is to provide an XLR cable connector by means of which the flexibility in creating XLR plug-and-socket connections is increased.

According to the invention, this is achieved by an XLR cable connector comprising a sliding element, by means of whose displacement between a retracted and advanced end position, the XLR cable connector can be converted between a plug for connecting with an XLR connector constructed as a socket and a socket for connecting with an XLR connector constructed as a plug and that has a first, second, third, and fourth channel, which lead to a plug-in-side front face of the sliding element at the corners of an imaginary square, whereby the first and second channels lie on diagonally opposed corners and the third and fourth channels lie on diagonally opposed corners, a first, a second, and a third contact pin that are received by the first, second, and third channel of the sliding element, whereby in the retracted position of the sliding element these contact pins project from the plug-in-side front face of the sliding element and the XLR cable connector with these contact pins can be inserted into the contact tubes of the socket, and in the advanced end position of the sliding element, these contact pins are retracted into the channels of the sliding element and sections of these channels are located on the plug-in side of the free ends of the contact pins and a first, a second, and a third socket contact, of which the first and the second socket contacts are arranged in the first and second channels and the third socket contact is arranged in the fourth channel, whereby in the advanced end position of the sliding element, the socket contacts can be contacted by the plug's contact pins inserted in the first, second, and fourth channels of the sliding element.

An XLR cable connector can thus be converted between a three-pin plug (male) and a three-pin socket (female), whereby a sliding element is displaced between a retracted and advanced end position. In the retracted end position of the sliding element, the XLR cable connector constitutes a plug, whereby the contact pins project from channels of the sliding element for insertion in an XLR connector constructed as a socket. In the advanced end position, the XLR cable connector forms a socket. The plug pins are hereby retracted into the channels of the sliding element, whereby two of these channels receiving contact pins together with the socket contacts arranged in these channels serve as the socket's contact tubes. In addition, the sliding element has another channel with a socket contact arranged in it that forms the third contact tube of the socket. In an advantageous embodiment of the invention, there extends into this additional channel a connecting pin lying parallel to the contact pins but shorter in length that is used for electrical contacting of the socket contact arranged in this channel.

Preferably, the sliding element is mounted displaceably between its end positions in a sleeve element forming a section of the plug housing. Accordingly, the sliding element is advantageously mechanically connected by means of an opening, in the sleeve element, extending in the sliding direction of the sliding element to a control element, by means of which displacement of the sliding element results. For example, the control element is constructed in the form of a sleeve encircling the sleeve element.

In an advantageous embodiment of the invention, the sliding element is lock-engaged at least in its advanced end position, preferably also in its retracted end position in relation to the sleeve element.

If within the scope of this document, one speaks of "front" and "back," this refers to the plug-in end of the connector, i.e., a part located more in the front is positioned closer to the plug-in end than a part located further back.

Additional advantages and details are explained hereafter using the attached drawing.

DESCRIPTION OF THE PREFERRED EMBODIMENTS

Figure 6:
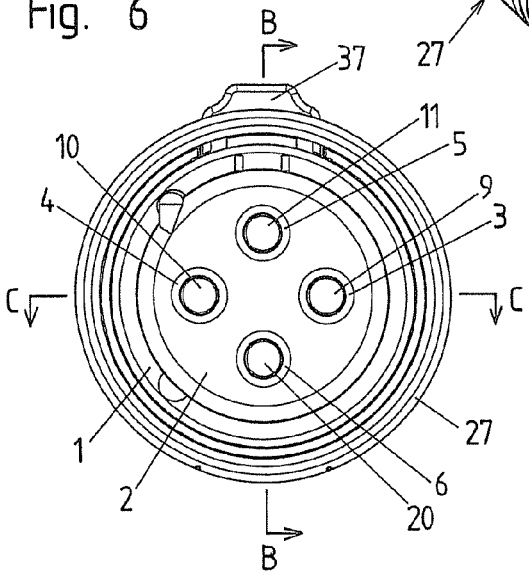
FIG. 6 depicts a frontal view of the XLR cable connector according to the invention from the plug-in side.
Figure 7:
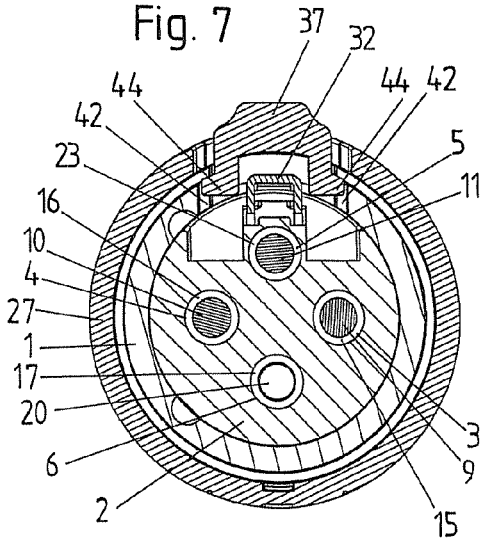
FIG. 7 depicts a cross-sectional view along line A-A of FIG. 8, rotated 180° about its longitudinal axis.
Figure 8:
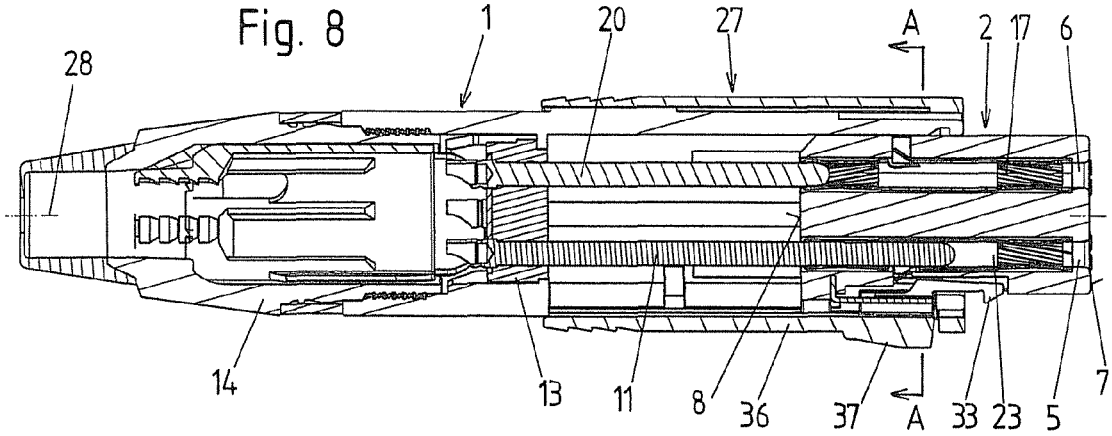
FIGS. 8 and 9 depict cross-sections along line B-B of FIG. 6, rotated 180° about the longitudinal axis, in the two end positions of the sliding element.
Figure 9:
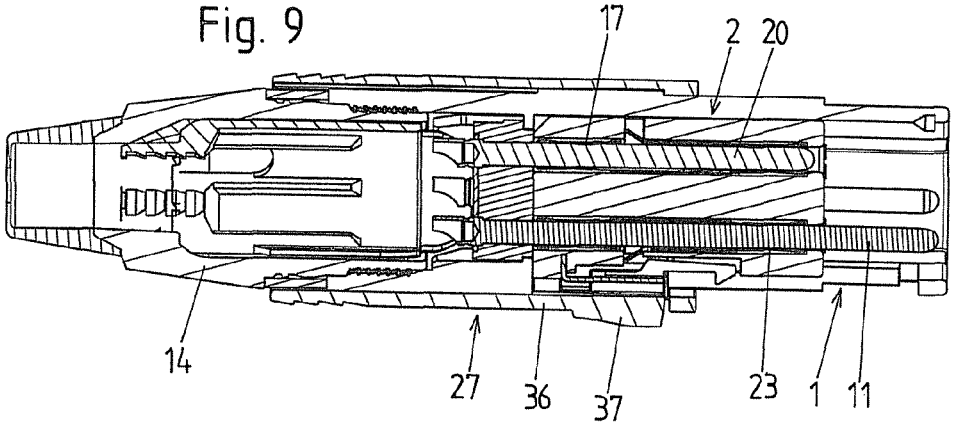
Figure 10:
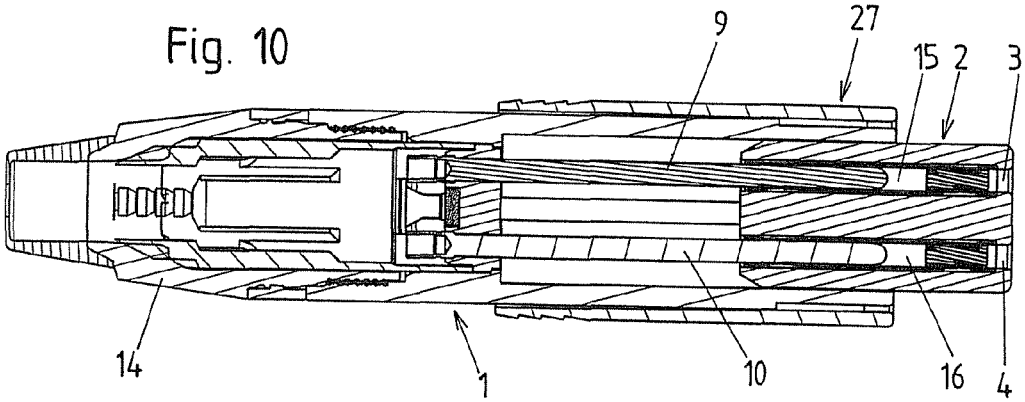
FIGS. 10 and 11 depict cross-sections along line C-C of FIG. 6 in both end positions of the sliding element.
Figure 11:
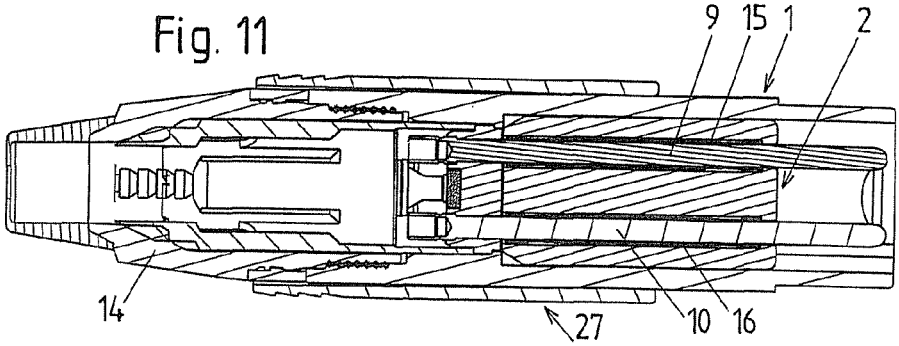

The XLR cable connector according to the invention and pursuant to the embodiment depicted in the drawings has a sliding element 2 displaceably mounted in a sleeve element 1 parallel to the longitudinal axis 28 of the XLR cable connector or the sleeve element 1. The sliding element 2 consisting of electrically insulating material has a first, a second, a third, and a fourth channel 3-6 that extend parallel to the longitudinal axis 28 of the XLR cable connector. On the plug-in-side front face 7 of the sliding element 2, these channels 3-6 meet at the corners of an imaginary rhombus as can be seen in the frontal view according to FIG. 6. Accordingly, the first and second channels 3, 4 lead to diagonally opposing corners and the third and fourth channels 5, 6 lead to the two other diagonally opposed corners. The channels 3-6 pass through the sliding element 2, thereby forming feed-through openings through the sliding element 2 and pass through it from its front face 8 turned away from the plug-in side to the plug-in-side front face 7.

The first, second, and third channels 3, 4, 5 receive a first, a second, and a third contact pin 9, 10, 11. In the retracted end position of the sliding element 2 (FIGS. 3-5, 9, 11), the contact pins 9, 10, 11 lying parallel to the longitudinal axis 28 of the XLR cable connector project on the plug-in side from channels 3, 4, 5. In contrast, in the advanced end position of the sliding element (FIGS. 1, 2, 8, 10), the contact pins 9, 10, 11 are retracted into the channels 3, 4, 5, whereby there are free sections of channels 3, 4, 5 on the plug-in side of the plug-in ends 12 of the contact pins 9, 10, 11. In this advanced end position of the sliding element, a section of the sliding element 2 projects out of the plug-in end of the sleeve element 1.

In the retracted end position of the sliding element 2, a section of the sleeve element 1 projects past the plug-in end of the sliding element 2. This plug-in end section of the sleeve element 1 encircles the sections, of the contact pins 9, 10, 11, that project from channels 3, 4, 5.

The contact pins 9, 10, 11 are held by a contact pin carrier 13 that is inserted in the sleeve element 1. In the embodiment depicted, the sleeve element 1, which here consists of a conductive material especially metal, and the contact pin carrier 13, which consists of an electrically insulating material, are separate parts. Basically, these two parts could also be constructed as a single unit, for example out of an electrically insulating plastic that can be equipped in the area of the sleeve element with a metal coating if a shield wire is to be connected.

The sleeve element 1 forms a part of a plug housing, which in the depicted embodiment also comprises an aft housing element 14 that can be joined with the sleeve element 1. For example, the two parts as depicted can be screwed together by means of an internal thread on one part and an external thread on the other part. The aft housing element 14 can, especially in the form of a collet, receive a formed cable tension relieving device. The plug housing can also be constructed in another form, for example constructed as a single piece, or it can comprise additional housing components.

Figure 1:
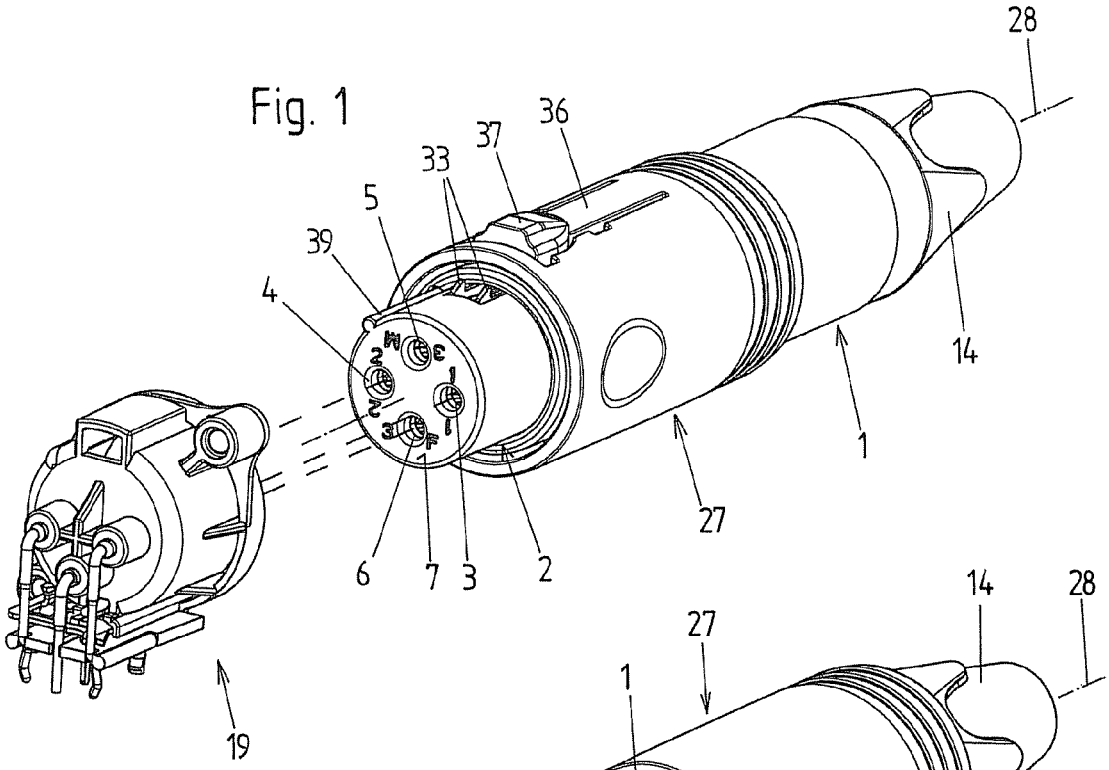
FIGS. 1 and 2 depict diagonal views of an XLR cable connector according to the invention in the advanced end position of the sliding element together with a conventional XLR connector constructed in the form of a chassis connector.
Figure 3:
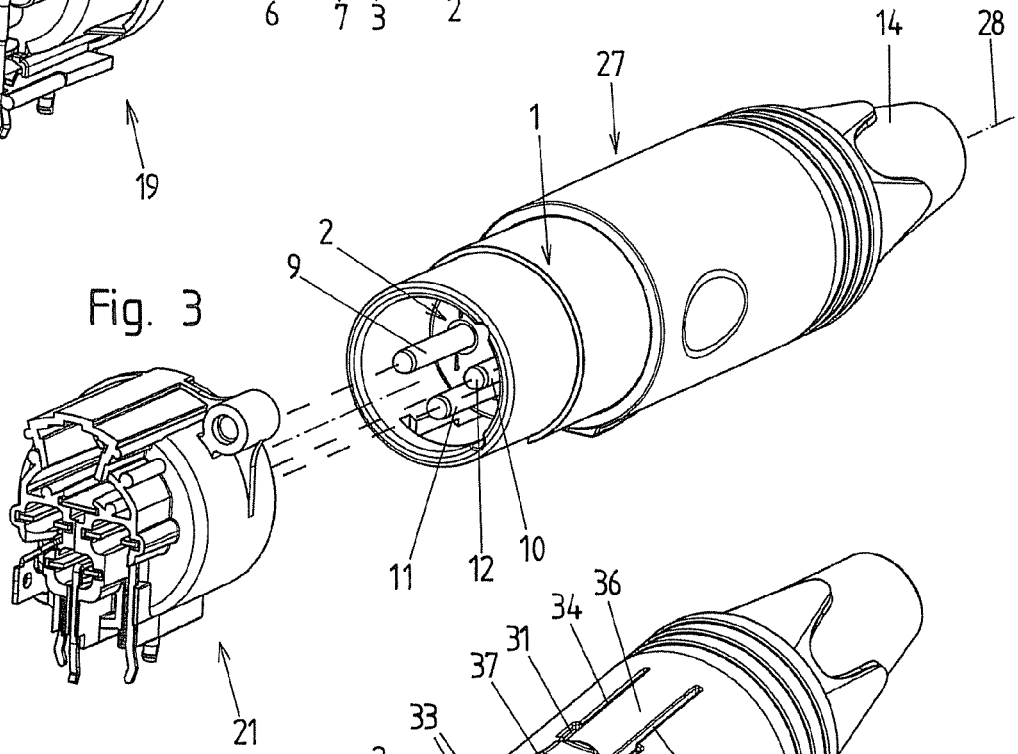
FIGS. 3 and 4 depict diagonal views similar to FIGS. 1 and 2 of the XLR cable connector according to the invention in the retracted end position of the sliding element together with a conventional XLR connector constructed in the form of a chassis connector.
Figure 5:
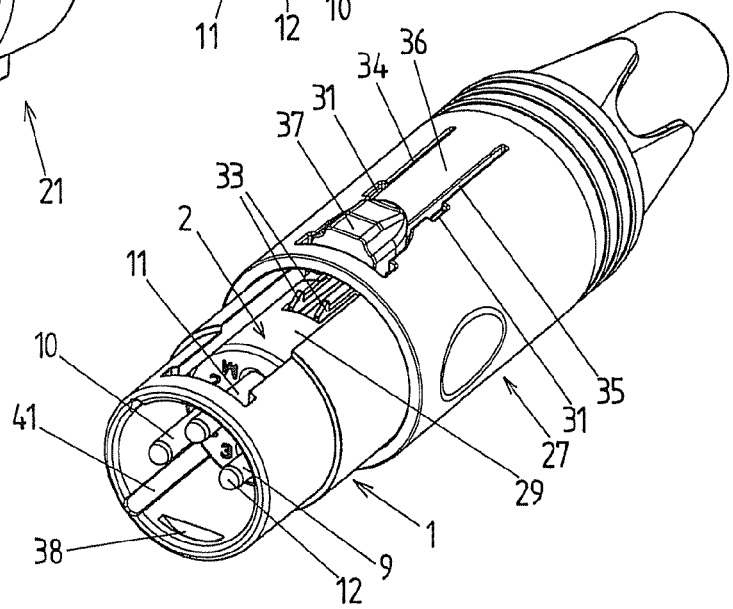
FIG. 5 depicts the XLR cable connector according to the invention in the retracted end position of the sliding element compared to FIGS. 3 and 4, rotated 180° about its longitudinal axis.
Figure 2:
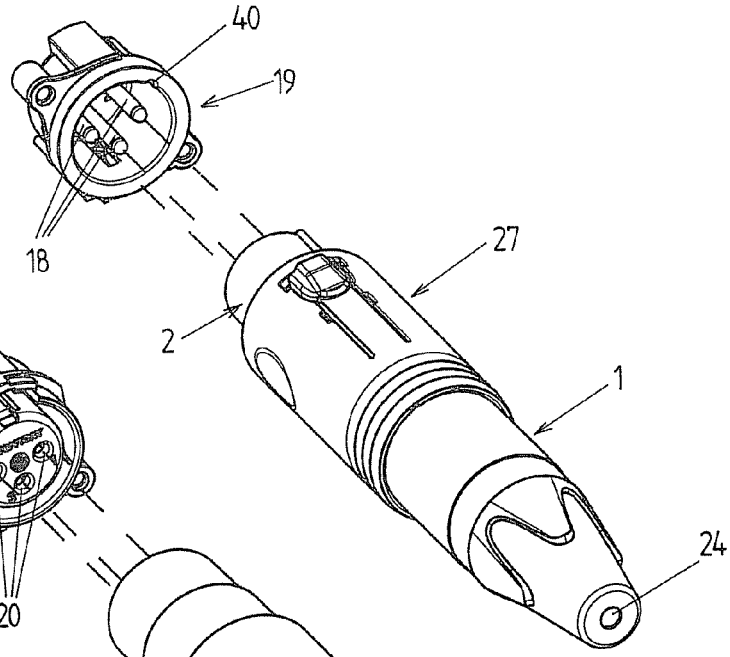
Figure 4:
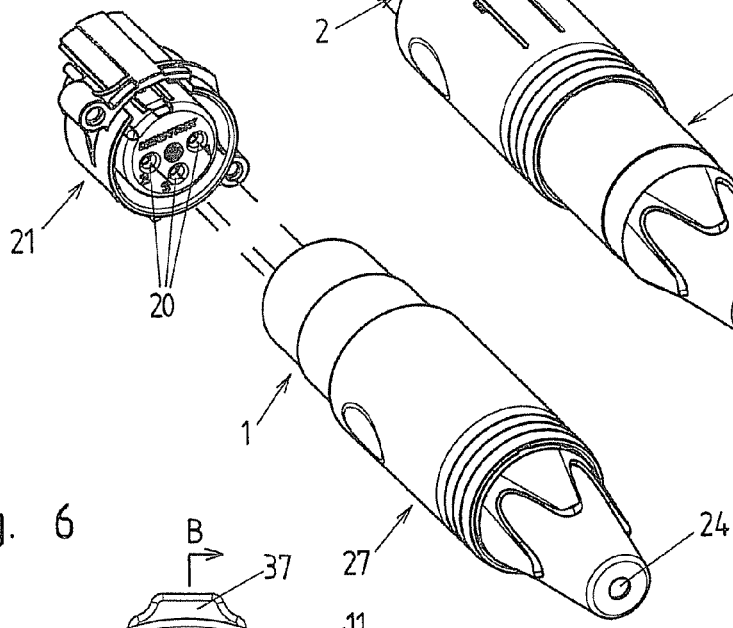

At least in the first, second, and fourth channels 3, 4, 6 of the sliding element, there are arranged socket contacts 15, 16, 17. In the advanced end position of the sliding element 2, these together with the plug-in end sections of the channels 3, 4, 6 form socket contacts for the contacting of contact pins 18 of an XLR plug 19 that, when in the advanced end position, can be inserted in the first, second, and fourth channel 3, 4, 6 of the sliding element 2. An example of a conventional XLR connector, which is constructed here in the form of a chassis connector and labeled plug 19, which can be connected to an XLR cable connector according to the invention is depicted in FIGS. 1 and 2.

In the retracted end position of the sliding element 2, the contact pins 9, 10, 11 projecting from the first, second, and third channels 3, 4, 5 can be inserted into contact tubes 20 of a conventional XLR connector constructed in the form of a socket 21. Such a socket 21 constructed in the form of a chassis connector is depicted as an example in FIGS. 3 and 4.

Figures 12, 13, 14:
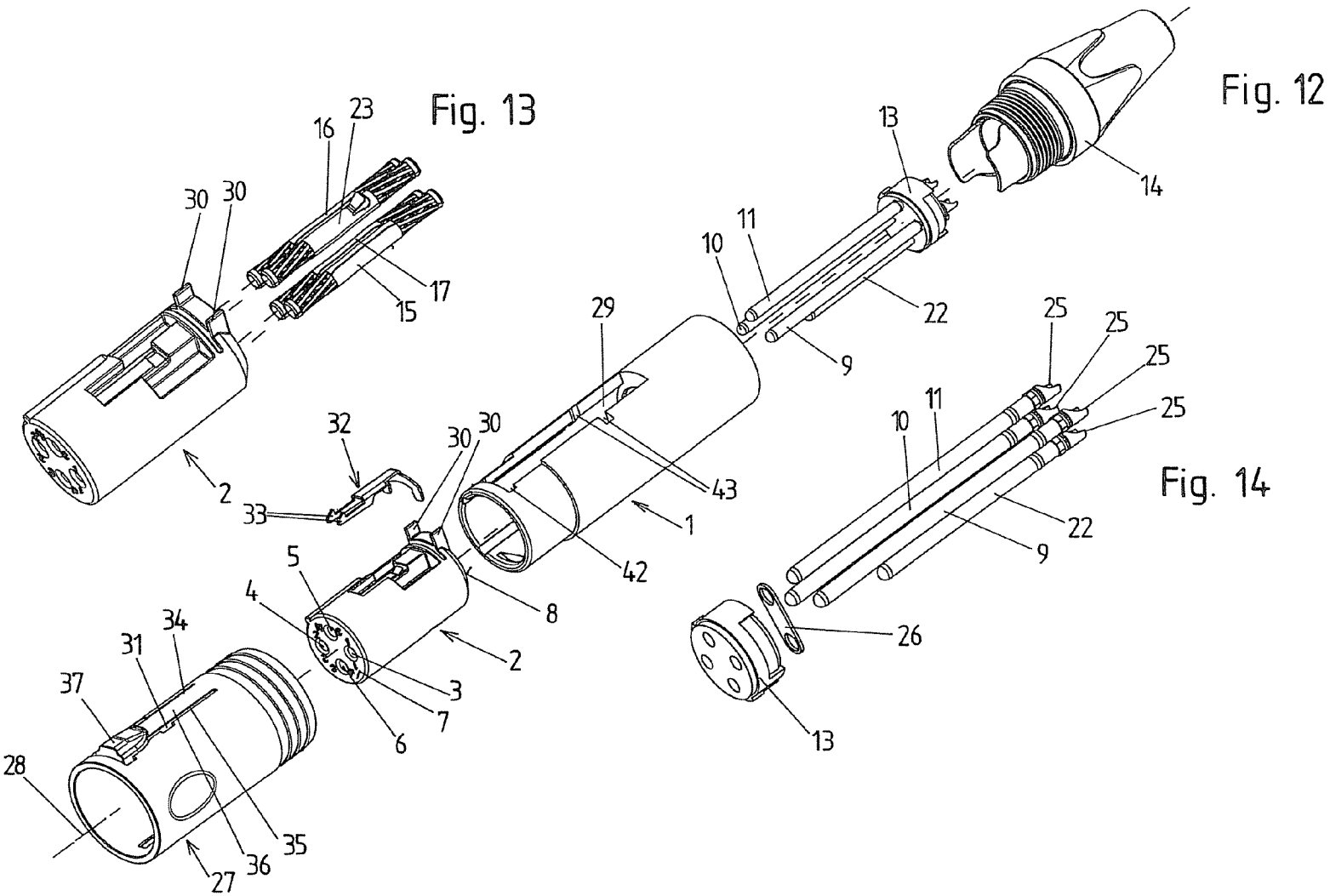
FIG. 12 depicts a diagonal view of the XLR cable connector according to the invention, whereby parts of the connector are shown in a magnified, separated manner.
FIG. 13 depicts a diagonal view of the sliding element with the extracted sleeve-shaped socket contacts.
FIG. 14 depicts a diagonal view of the contact pin carrier with extracted contact pins.

The socket contacts 15, 16, 17 are preferably constructed in a sleeve-shape, as can be seen in FIG. 13 especially. In this case, the first and second socket contacts 15, 16 arranged in the first and second channels 3, 4 also serve to guide the first and second contact pins 9, 10, whereby these contact pins 9, 10 also project, in the advanced end position of the sliding element 2, in aft sections of the first and second socket contacts 15, 16 and contact them electrically. The electrical contacting of the first and second socket contacts 15, 16 thus takes place by means of the first and second contact pins 9, 10.

Simple contacting of the third socket contact 17 can be achieved as shown by a connecting pin 22 that is oriented parallel to the contact pins 9, 10, 11 and projects into the fourth channel 6 of the sliding element 2. In this case, it has a shorter reach in the direction of the plug-in side, so that even in the retracted end position of the sliding element 2 it does not project out of the plug-in end of the fourth channel 6. In the advanced end position of the sliding element 2 however, it still projects into the sleeve-shaped third socket contact 17 and contacts it electrically. Instead, the contacting of the third socket contact 17 could also result in a different manner, for example by means of a stranded wire or a sliding contact on the exterior surface of sliding element 2. The fourth channel 6 could then also be constructed as a blind hole extending from the corner of the sliding element 2, in other words not extending to the front face 8 of the sliding element 2.

The third contact pin 11 is electrically connected to the third socket contact 17, in the depicted embodiment by means of a connecting element 26, which contacts on the one hand the third contact pin 11, and on the other hand contacts the connecting pin 22 and which is constructed for example in the form of a small plate with two holes for mounting on the contact pin 11 and connecting pin 22.

In the third channel 5, there is a guide sleeve 23 for the third contact pin 11. For simplicity's sake, this has the same construction as the socket contacts 15, 16, 17. Instead a guide sleeve constructed in a different manner could also be provided for the contact pin 3 or such a separate guide sleeve could also be omitted.

Instead of sleeve-shaped socket contacts 15, 16, 17, these could also be constructed in a different manner, for example in the form of brackets or small plates. Accordingly, separate guide sleeves could be provided to guide the contact pins 9, 10 and/or connecting pin 22. Also in this case, the electrical contacting of the first and second socket contacts 15, 16 can result by means of the contact pins 9, 10 and/or the contacting of the third socket contact 17 via a connecting pin 22.

The XLR cable connector depicted in the embodiment is used for connecting to an electrical cable; in other words, it is a cable connector or a free connector. Accordingly, the cable is inserted through the aft opening 24 in the aft housing element 14 and the cable cores are connected to the contact pins 9, 10, 11. The contact pins 9, 10, 11 hereby have soldering elements 25 on their ends back from the plug-in side. Since the third contact pin 11 is connected to the connecting pin 22 via the connecting element 26, the connection of the corresponding cable cores can result either with the contact pin 11 or the connecting pin 22 that also has a soldering element 25 for this purpose. The soldering element 25 of either the contact pin 11 or the connecting pin 22 could also be omitted.

Instead of the soldering elements 25, other connecting elements, such as crimping elements, could also be present.

To displace the sliding element 2, one uses an operating element 27 that lies outside of the sleeve element 1 and that is mechanically connected to the sliding element 2. The connection results by means of an opening 29 extending through the sleeve element 1 in the direction of the longitudinal axis 28. In the depicted embodiment, outwardly protruding arms 30 of the sliding element 2 that pass through the opening 29 engage in recesses 31 of the operating element 27.

The operating element 27 consisting of plastic for example is constructed in a sleeve-shape in the depicted embodiment and encircles sleeve element 1. Other constructions are also conceivable and possible.

In XLR connectors, the socket usually has a catch with detents that snap into a recess of the projecting section of the housing of the connector. For this purpose, a catch 32 with detents 33 is arranged on the sliding element 2, where the detents, in the advanced end position of the sliding element 2, lie in the area of the section of the sliding element 2 that projects beyond the sleeve element 1 and extend beyond it radially to the outside. When inserted into the plug 19, these engage into the recesses of the plug 19. In the area of the catch 32, the sliding element 2 is provided with a recess.

The operating element 27 has an actuating arm 36, released by a slit 34, 35 running in the direction of the longitudinal axis 28, along with an actuating piece 37. By pressing on the actuating piece 37, which hereby acts through the opening 29 in sleeve element 1, the detents 33 can be displaced radially inward so that they disengage with the recess in plug 19 and the XLR cable connector can be pulled out of the plug 19.

To lock in an XLR cable connector inserted in a socket 21 in the retracted end position of the sliding element 2, a recess 38 is used in the interior surface of the section of sleeve element 1 projecting beyond the sliding element 2. In a connected state of both connectors, detents of a catch of the socket 21 (not depicted in FIGS. 3 and 4) engage into this recess 38.

On the outer surface of the section of the sliding element 2 projecting from sleeve element 1 when the sliding element is in its advanced end position, there is a centering rib 39, running in an axial direction of the XLR cable connector, that, when plug 19 is plugged in, is inserted into a groove 40 of the plug 19, whereby the correct angularity of both plug elements is predetermined.

The centering rib 39 is guided into a groove 41, running in an axial direction, on the interior surface of the sleeve element 1, whereby the sliding element 2 is secured from rotating in relation to the sleeve element 1.

To assemble the XLR cable connector, the sliding element 2 is inserted, in a direction inclined to the longitudinal axis of the sleeve element 1, with its arms 30 into the opening 29 of the sleeve element 1. To insert the arms 30 into the recesses 31 of the operating element 27, the operating element 27 has inlet channels along its inner surface and the somewhat elastically constructed material of the operating element 27 is somewhat deformed (to an oval cross-sectional contour of the operating element 27).

The conversion of an XLR cable connector according to the invention between a plug and a socket thus takes place as already mentioned by means of an axial displacement of the sliding element 2 via operating element 27. In this case, there preferably results in the two end positions of the sliding element 2 a lock-engagement of the sliding element 2 in relation to sleeve element 1. In the depicted embodiment, the recess 31 has, for this purpose, enlargements 42, 43 on two locations of its axial extension. Into these extend, in a non-actuated state of the actuating piece 37, protrusions 44 that are located on radially inward projecting arms of the actuating piece 37 if the sliding element 2 is in one of its end positions. To disengage the protrusions 44 from the respective enlargements 42, 43, the actuating piece 37 is lightly pressed from its neutral position (which receives it without the action of external forces due to the elasticity of the actuating arm 36). In contrast, the displacement of the detents 33 first takes place after pressing more forcefully on the actuating piece 37.

Advantageously, there is a lock-engagement of the sliding element in relation to sleeve element 1 at least in the advanced end position of the sliding element 2 in order to prevent a rearward movement of the sliding element 2 at the time of insertion into a plug.

The sections of the first and second channels 3, 4 lying in front of the plug-in ends 12 of the contact pins 9, 10 and the corresponding section of the fourth channel 6 form together with the socket contacts 15, 16, 17 contact tubes as described in order to electrically connect the XLR cable connector, in the advanced end position of the sliding element 2, with a plug. These contact tubes are hereby located at the corners of an imaginary right-angled isosceles triangle, as seen from a frontal view of the connector. In the retracted end position of the sliding element 2, the plug-in ends 12 of the contact pins 9, 10, 11 are also on the corners of an imaginary isosceles triangle, whereby these two triangles are rotated 180° to each other in relation to the longitudinal axis 28 of the connector. To initially plug in the XLR cable connector into a plug 19 (with the sliding element 2 in the advanced position) and then into a socket 21 (with the sliding element 2 in the retracted position), which has the same geometric contact arrangement as the plug 19, the XLR cable connector according to the invention must be rotated 180° about its longitudinal axis 28, as can be best seen in FIGS. 1 to 4.

An XLR cable connector according to the invention can thus be used both as a three-pin XLR plug as well as a three-pin XLR socket, whereby a correct assignment of the contact pins 9, 10, 11 or socket contacts 15, 16, 17 exists without changing the connections of the cable cores to the contact pins 9, 10, 11 or the socket contacts 15, 16, 17. A cable to which an XLR cable connector according to the invention is connected can thus be connected to both a plug as well as a socket according to the XLR standard.

As emerges from the aforementioned description, the scope of the invention is not restricted to the depicted embodiments, but should be defined taking into consideration the attached claims together with its entire scope of possible equivalents.

PARTS LIST

1 Sleeve element
2 Sliding element
3 First channel
4 Second channel
5 Third channel
6 Fourth channel
7 Plug-in-side front face
8 Front face
9 First contact pin
10 Second contact pin
11 Third contact pin
12 Plug-in end
13 Contact pin carrier
14 Aft housing element
15 First socket contact
16 Second socket contact
17 Third socket contact
18 Contact pin
19 Plug
20 Contact tube
21 Socket
22 Connecting pin
23 Guide sleeve
24 Opening
25 Soldering element
26 Connecting element
27 Operating element
28 Longitudinal axis
29 Opening
30 Arm
31 Recess
32 Catch
33 Detent
34 Slit
35 Slit
36 Actuating arm
37 Actuating piece
38 Recess
39 Centering rib
40 Groove
41 Groove
42 Enlargement
43 Enlargement
44 Protrusion

The invention claimed is:

1. A cable connector of a three-terminal XLR type, comprising:

a) a movable element slidable between a retracted end position, wherein said cable connector is configured as a three-terminal XLR type plug for connection to a mating connector having an XLR socket, and an advanced end position wherein said cable connector is configured as a three-terminal XLR type socket for connection to a mating connector having an XLR plug, said movable element having first, second, third, and fourth channels opening onto a plug-in-side front face of said movable element wherein said four channels are arranged at the corners of a square, wherein said first and second channels lie at diagonally opposing corners and said third and fourth channels lie at diagonally opposing corners of said square;

b) first, second, and third contact pins slidably disposed in respective of said first, second, and third channels wherein, in said retracted end position of said movable element where said movable element moves backward from an engaging position, said contact pins project from said plug-in-side front face of said movable element such that said first, second, and third contact pins may be engaged by respective first, second, and third sockets of a mating connector having an XLR socket, and wherein, in said advanced end position of said movable element where said moveable element moves forward to said engaging position, said first, second, and third contact pins are completely covered in said channels; and, c) first, second, and third socket contacts wherein said first and second socket contacts are arranged in said first and second channels and said third socket contact is arranged in said fourth channel such that in said advanced end position of said movable element, said first, second, and third socket contacts may be engaged by respective of first, second, and third contact pins of a mating connector having an XLR plug when said first, second, and third contact pins are inserted into said first, second, and fourth channels of said movable element.

2. A cable connector according to claim 1, wherein said first and second contact pins, in said retracted end position of said sliding element, electrically contact said first and second socket contacts, respectively.

3. A cable connector according to claim 1, wherein said third contact pin is electrically connected to said third socket contact.

4. A cable connector according to claim 3, wherein in said retracted end position of said sliding element, said third socket contact arranged in said fourth channel of said sliding element is electrically contacted by a connecting pin projecting into said fourth channel.

5. A cable connector according to claim 4, wherein a connecting element is electrically connected to said third contact pin and to said connecting pin.

6. A cable connector according to claim 1, wherein said first, second, and third socket contacts are sleeve-shaped.

7. A cable connector according to claim 1, wherein a guide sleeve is arranged in said first channel of said sliding element having the same construction as said first, second, and third socket contacts.

8. A cable connector according to claim 1, wherein said sliding element is encircled by a sleeve element and is mounted so that said sliding element is displaceable between said respective advanced and retracted end positions.

9. A cable connector according to claim 8, wherein said sliding element is mechanically connected to an operating element arranged outside of said sleeve element through an opening through said sleeve element, such that said sliding element is displaceable between said respective advanced and retracted end positions.

10. A cable connector according to claim 9, wherein said operating element encircles said sleeve element.

11. A cable connector according to claim 8, wherein said first, second, and third contact pins are held by a contact pin carrier inserted into said sleeve element.

12. A cable connector according to claim 8, wherein an aft housing element is mechanically connected to the end of said sleeve element facing away from said plug-in side front face.

13. A cable connector according to claim 1, wherein said sliding element has a catch with at least one detent to engage a recess in a plug housing connected to said cable connector.

14. A cable connector according to claim 13, wherein said at least one detent is radially displaceable with respect to the longitudinal axis of said cable connector by means of an actuating piece of said operating element extending through said opening through said sleeve element.

15. A cable connector according to claim 7, wherein said sliding element includes a centering rib extending in an axial direction and guided in an axial groove in said sleeve element, said centering rib being matable with a groove of a plug.

16. A cable connector according to claim 8, wherein said sliding element when in said advanced end position with respect to said sleeve element is lock-engaged.

17. A cable connector according to claim 8, wherein said sliding element when in said retracted end position with respect to said sleeve element is lock-engaged.

18. A cable connector according to claim 1 wherein said connector must be rotated 180° about a longitudinal axis thereof during conversion of said connector from use as a plug to use as a socket.

19. A cable connector of a three-terminal XLR type, comprising:

a) a movable element slidable between a retracted end position, wherein said cable connector is configured as a three-terminal XLR type plug for connection to a mating connector having an XLR socket, and an advanced end position wherein said cable connector is configured as a three-terminal XLR type socket for connection to a mating connector having an XLR plug, said movable element having first, second, third, and fourth channels opening onto a plug-in-side front face of said movable element wherein said four channels are arranged at the corners of a square, wherein said first and second channels lie at diagonally opposing corners and said third and fourth channels lie at diagonally opposing corners of said square;

b) first, second, and third contact pins slidably disposed in respective of said first, second, and third channels wherein, in said retracted end position of said movable element where said movable element moves backward from an engaging position, said contact pins project from said plug-in-side front face of said movable element such that said first, second, and third contact pins may be engaged by respective first second, and third sockets of a mating connector having an XLR socket, and wherein, in said advanced end position of said movable element where said movable element moves forward to said engaging position, said first, second, and third contact pins are completely covered in said channels; and, c) first, second, and third socket contacts, wherein said first and second socket contacts are arranged in said first and second channels and said third socket contact is arranged in said fourth channel such that in said advanced end position of said movable element, said first, second, and third socket contacts may be engaged by respective of said first, second, and third contact pins of a mating connector having an XLR plug when said first, second, and third contact pins are inserted into said first, second, and fourth channels of said movable element, and wherein said sliding element is encircled by a sleeve element and is mounted so that said sliding element is displaceable between said respective advanced and retracted end positions, and, wherein said sliding element is mechanically connected to an operating element arranged outside of said sleeve element through an opening through said sleeve element, such that said sliding element is displaceable between the respective advanced and retracted end positions, and wherein said operating element encircles said sleeve element.

20. A cable connector of a three-terminal XLR type, comprising:

a) a movable element slidable between a retracted end position, wherein said cable connector is configured as a three-terminal XLR type plug for connection to a mating connector having an XLR socket, and an advanced end position wherein said cable connector is configured as a three-terminal XLR type socket for connection to a mating connector having an XLR plug, said movable element having first, second, third, and fourth channels opening onto a plug-in-side front face of said movable element wherein said four channels are arranged at the corners of a square, wherein said first and second channels lie at diagonally opposing corners and said third and fourth channels lie at diagonally opposing corners of said square;

b) first, second, and third contact pins slidably disposed in respective of said first, second, and third channels wherein, in said retracted end position of said movable element where said movable element moves backward from an engaging position, said contact pins project from said plug-in-side front face of said movable element such that said first, second, and third contact pins may be engaged by respective first second, and third sockets of a mating connector having an XLR socket, and wherein, in said advanced end position of said movable element where said movable element moves forward to said engaging position, said first, second, and third contact pins are completely covered in said channels; and, c) first, second, and third socket contacts, wherein said first and second socket contacts are arranged in said first and second channels and said third socket contact is arranged in said fourth channel such that in said advanced end position of said movable element, said first, second, and third socket contacts may be engaged by respective of said first, second, and third contact pins of a mating connector having an XLR plug when said first, second, and third contact pins are inserted into said first, second, and fourth channels of said movable element, and wherein said sliding element is encircled by a sleeve element and is mounted so that said sliding element is displaceable between the respective advanced and retracted end positions, and wherein said first, second, and third contact pins are held by a contact pin carrier in said sleeve element.

21. A cable connector of a three-terminal XLR type, comprising:

a) a movable element slidable between a retracted end position, wherein said cable connector is configured as a three-terminal XLR type plug for connection to a mating connector having an XLR socket, and an advanced end position wherein said cable connector is configured as a three-terminal XLR type socket for connection to a mating connector having an XLR plug, said movable element having first, second, third, and fourth channels opening onto a plug-in-side front face of said movable element wherein said four channels are arranged at the corners of a square, wherein said first and second channels lie at diagonally opposing corners and said third and fourth channels lie at diagonally opposing corners of said square;

b) first, second, and third contact pins slidably disposed in respective of said first, second, and third channels wherein, in said retracted end position of said movable element where said movable element moves backward from an engaging position, said contact pins project from said plug-in-side front face of said movable element such that said first, second, and third contact pins may be engaged by respective first second, and third sockets of a mating connector having an XLR socket, and wherein, in said advanced end position of said movable element where said movable element moves forward to said engaging position, said first, second, and third contact pins are completely covered in said channels; and, c) first, second, and third socket contacts, wherein said first and second socket contacts are arranged in said first and second channels and said third socket contact is arranged in said fourth channel such that in said advanced end position of said movable element, said first, second, and third socket contacts may be engaged by respective of said first, second, and third contact pins of a mating connector having an XLR plug when said first, second, and third contact pins are inserted into said first, second, and fourth channels of said movable element, and wherein said sliding element has a catch with at least one detent to engage a recess in a plug housing connected to said cable connector.

22. A cable connector of a three-terminal XLR type, comprising:

a) a movable element slidable between a retracted end position, wherein said cable connector is configured as a three-terminal XLR type plug for connection to a mating connector having an XLR socket, and an advanced end position wherein said cable connector is configured as a three-terminal XLR type socket for connection to a mating connector having an XLR plug, said movable element having first, second, third, and fourth channels opening onto a plug-in-side front face of said movable element wherein said four channels are arranged at the corners of a square, wherein said first and second channels lie at diagonally opposing corners and said third and fourth channels lie at diagonally opposing corners of said square;

b) first, second, and third contact pins slidably disposed in respective of said first, second, and third channels wherein, in said retracted end position of said movable element where said movable element moves backward from an engaging position, said contact pins project from said plug-in-side front face of said movable element such that said first, second, and third contact pins may be engaged by respective first second, and third sockets of a mating connector having an XLR socket, and wherein, in said advanced end position of said movable element where said movable element moves forward to said engaging position, said first, second, and third contact pins are completely covered in said channels; and, c) first, second, and third socket contacts, wherein said first and second socket contacts are arranged in said first and second channels and said third socket contact is arranged in said fourth channel such that in said advanced end position of said movable element, said first, second, and third socket contacts may be engaged by respective of said first, second, and third contact pins of a mating connector having an XLR plug when said first, second, and third contact pins are inserted into said first, second, and fourth channels of said movable element, and wherein a guide sleeve is arranged in said first channel of said sliding element having the same construction as said first, second, and third socket contacts, and wherein said sliding element includes a centering rib extending in an axial direction and guided in an axial groove in said sleeve element, said centering rib being matable with a groove of a plug.

* * * * *